United States Patent [19]

Laude et al.

[11] 4,424,094

[45] Jan. 3, 1984

[54] FABRIC SHEARING AND HEATING TOOL

[75] Inventors: Michael Laude, Danbury; Michael Marra, Huntington, both of Conn.; Corbett W. Stone, South Salem, N.Y.; Artin G. Vartoukian, Roselle Park, N.J.

[73] Assignee: The Singer Company, Stamford, Conn.

[21] Appl. No.: 372,496

[22] Filed: Apr. 28, 1982

[51] Int. Cl.[3] ..... B32B 31/18

[52] U.S. Cl. ..... 156/513; 156/98; 156/256; 156/258; 156/514; 156/579

[58] Field of Search ..... 156/94, 98, 250, 256, 156/443, 492, 493, 513, 514, 579, 258, 267, 512; 269/1, 2, 47, 48, 287, 288, 901; 264/36; 112/70, 76, 103, 114, 121.15

[56] References Cited

U.S. PATENT DOCUMENTS

| | | | |
|---|---|---|---|
| 138,357 | 4/1873 | Allen . | |
| 2,759,090 | 8/1956 | Frye | 219/21 |
| 2,924,694 | 2/1960 | Kreider | 219/21 |
| 3,271,217 | 9/1966 | Mapson | 156/98 |
| 4,047,300 | 9/1977 | Sweeney, Jr. | 156/98 |
| 4,358,335 | 11/1982 | Reinert | 156/514 |

OTHER PUBLICATIONS

U.S. appln. Ser. No. 284,877, filed 7/20/81.

*Primary Examiner*—Caleb Weston

*Attorney, Agent, or Firm*—William V. Ebs; Robert E. Smith; Edward L. Bell

[57] ABSTRACT

A fabric repairing tool is provided with a cutter which is operable in a one-shot shearing operation to remove a portion of fabric from a folded piece of material held in the tool with a foldable clamp, and is further provided with heating means which is energizable to a controlled temperature effective in a desirable period of time to bond a thermoplastic pad and patch to a damaged fabric.

11 Claims, 11 Drawing Figures

FABRIC SHEARING AND HEATING TOOL

DESCRIPTION

BACKGROUND OF THE INVENTION

1. Field of the Invention

The invention relates to devices for use in the repair of a damaged garment and more particularly to devices for use in the repair of a damaged area of fabric with a patch of material which is the same as the damaged fabric.

2. Description of the Prior Art

A known procedure for repairing a damaged garment includes as a first step, punching or cutting a hole in the fabric at the damaged site of sufficient size to include all of the damaged area. A patch corresponding in size and shape to such hole is then punched or cut out of a piece of fabric like the damaged fabric for use in making the repair, the patch preferably being taken from an unnoticeable part of the damaged garment to assure a match at the damaged site. A pad impregnated with a thermoplastic adhesive is located under the hole and the patch is placed in the hole, after which heat is applied over the patch to momentarily melt the plastic in the pad and cause it to flow into the interstices of adjacent portions of the garment and patch to complete the repair. The tools used in repairing a garment as described have consisted of hole punching or cutting, and heating devices of the kind shown and described for example in: U.S. Pat. No. 4,047,300 of John I. Sweeney, Jr. for "Method and Apparatus for Repairing Damaged Materials Particularly Suited to Repairing Knit or Polyester Materials", issued Sept. 13, 1977; U.S. Pat. No. 3,513,048 of B. L. Synder for "Method for Making a Patch Structure for Fabrics" issued May 19, 1970; U.S. Pat. No. 3,271,217 of D. L. Mapson for "Method for Mending Holes in Fabrics" issued Sept. 6, 1966; and U.S. Pat. No. 4,358,335.

It has been a disadvantage of the prior art hole punching and cutting devices that they could not conveniently be used to punch or cut out a hole in a garment without also damaging any lining which the garment might have. It has also been a disadvantage of such hole making devices that it was difficult with them to obtain a clean edged hole or patch, and when fragments of yarn remained, a repair which would be unnoticeable could not readily be made. Further, the prior art fabric repairing tools were awkward to handle, and did not include a temperature controlled device enabling an operator to consistently obtain an effective bond between a patch and surrounding portion of a damaged fabric with the controlled melting of a thermoplastic adhesive from an impregnated pad disposed under the fabric at the damaged site.

It is a prime object of the invention to provide an improved fabric repairing tool with which a hole and patch can readily be cut out of a lined piece of fabric without damage to the lining.

It is another object of the present invention to provide an improved fabric repairing tool with which a hole and a patch can be cleanly cut out of a fabric with a unidirectionally moving cutter in a one-shot shearing operation.

It is still another object of the invention to provide an improved fabric repairing hand tool which can be comfortably held, and then easily operated with the movement of a pivoted lever to cut a hole and patch out of a piece of fabric.

It is also an object of the invention to provide an improved fabric repairing tool with which an operator can bond a patch to surrounding fabric with a thermoplastic material at a controlled temperature.

Other objects and advantages of the invention will become apparent hereinafter during a reading of the specification taken in connection with the accompanying drawings.

A fabric repairing tool is provided according to the invention with a body member and a cutter which is slidable in the body member. The body member includes a transverse slot for receiving a foldable fabric clamp. The clamp is formed with a through opening which extends to opposite sides of a fold line, and wherein a portion of a fabric piece can be located and then folded with the clamp. The folded clamp is positionable in the slot in the body member with such fabric portion in the path of movement of the cutter which can then be activated and caused to remove the said fabric portion from the fabric.

DESCRIPTION OF THE INVENTION

Figure 1:
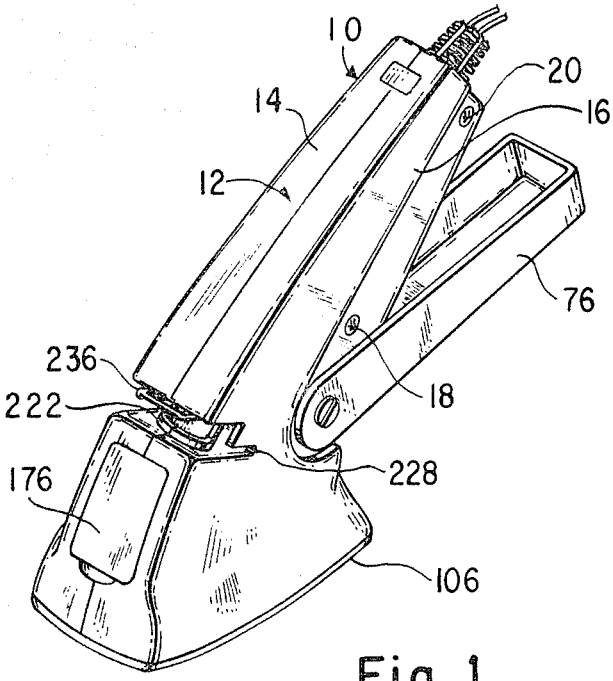
FIG. 1 is a perspective view of the fabric shearing and heating tool of the invention.
Figure 2:
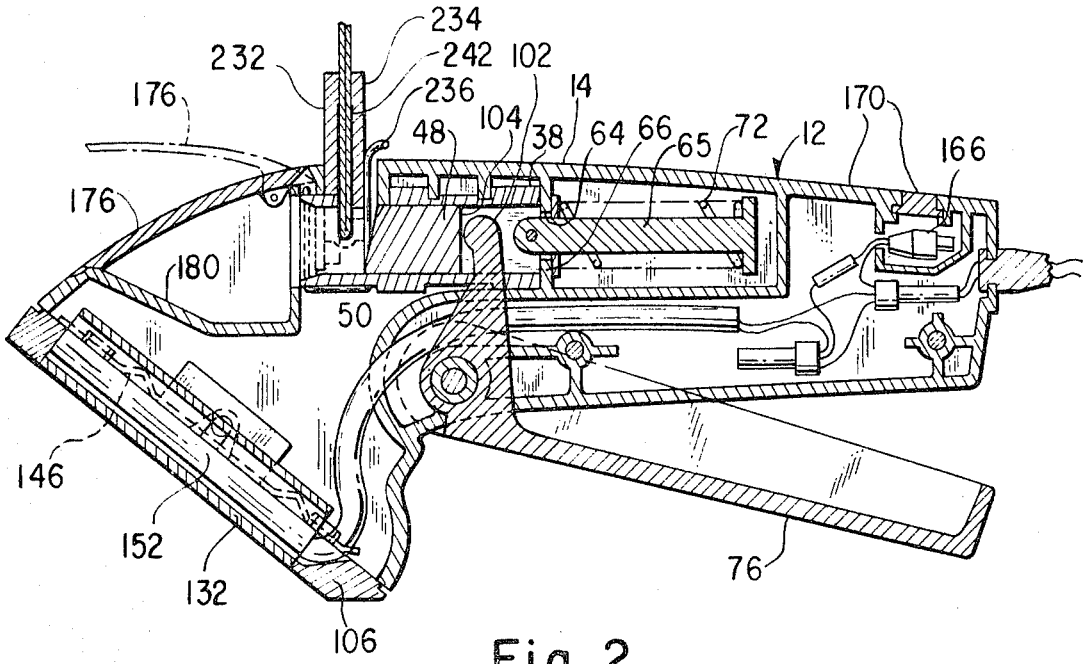
FIG. 2 is a vertical longitudinal sectional view of the tool of FIG. 1.
Figure 3:
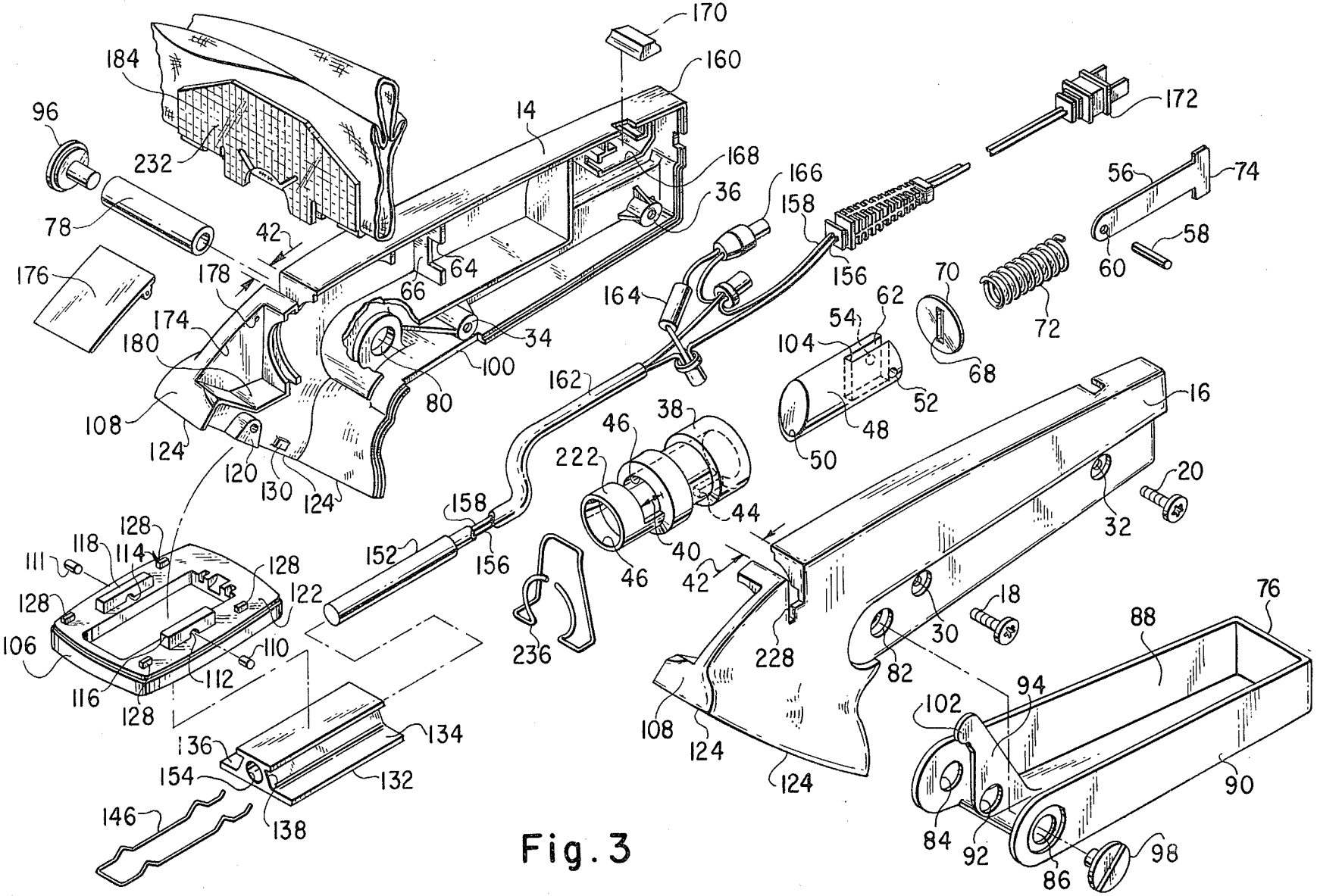
FIG. 3 is a disassembled perspective view of the tool.
Figure 4:
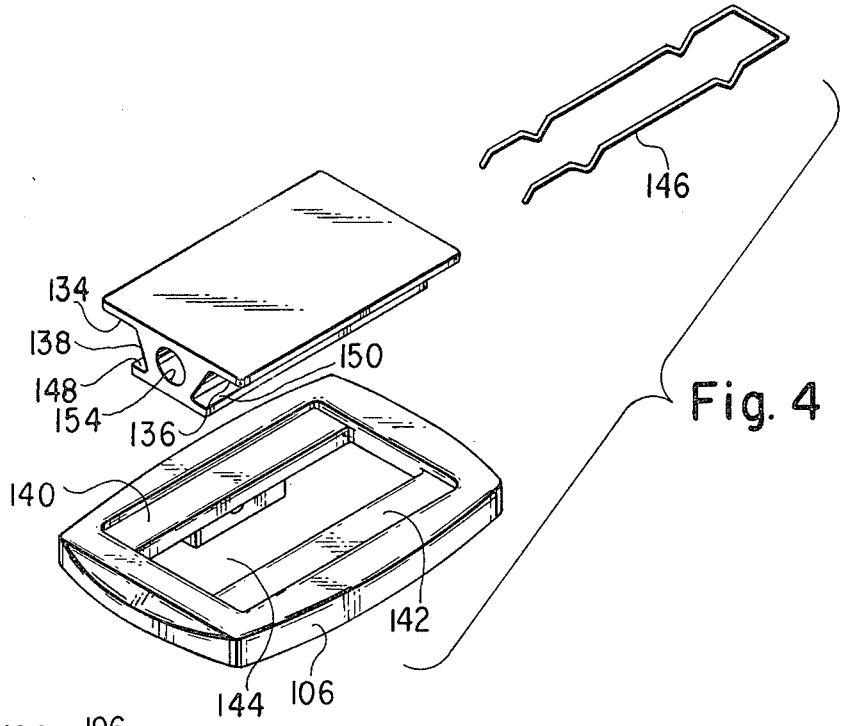
FIG. 4 is a bottom disassembled perspective view of the heating platten of said tool and the mounting block therefor.
Figure 6:
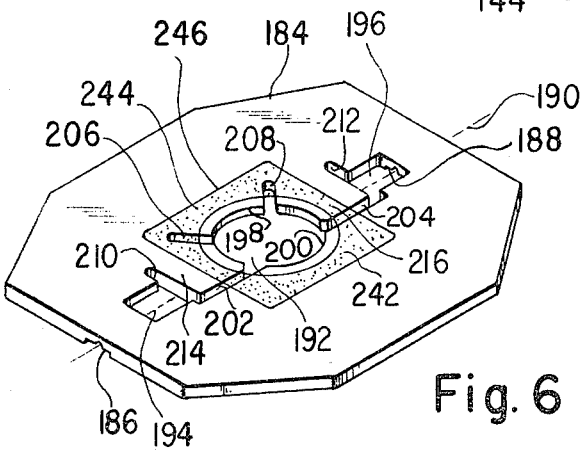
FIG. 6 is an inside perspective view of a fabric clamp.
Figure 5:
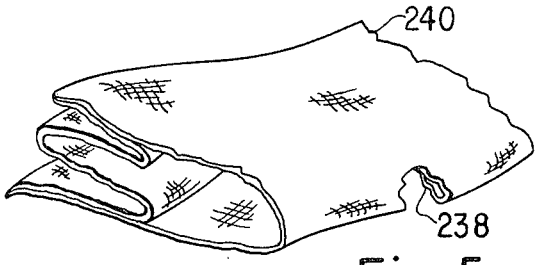
FIG. 5 is a perspective view of a piece of damaged fabric which is to be repaired with said tool.
Figure 7:
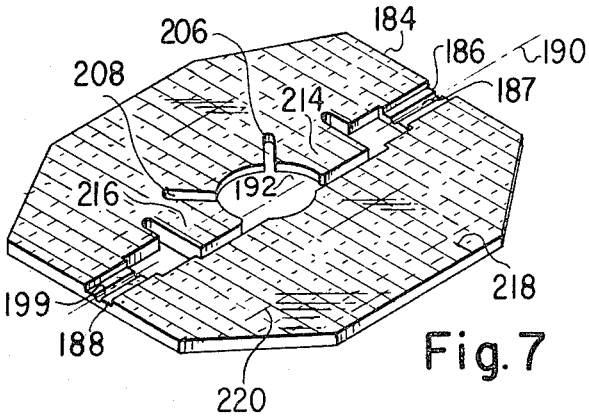
FIG. 7 is an outside perspective view of the clamp.
Figure 8:
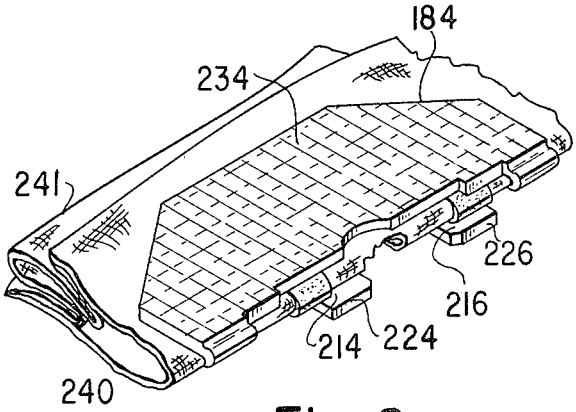
FIG. 8 is a perspective view showing the damaged fabric in the clamp.

Referring to the drawings, reference character 10 designates a fabric repairing tool according to the invention. The tool is provided with a hollow molded plastic handle 12 consisting of housing portions 14 and 16 which are held together with screws 18 and 20 extending through unthreaded holes 30 and 32 in one part 16 and into threaded bosses 34 and 36 in the other part 14.

A body member 38 is held affixed within the housing portions 14 and 16 of the tool. The body member is a generally cylindrical structure which includes a transverse slot 40 in alignment with a slot 42 in the handle, and a longitudinally extending bottom slot 44. A through circular opening 46 extends through the body member. A cylindrical cutter 48 extends into and is slidable in the through opening 46. The cutter 48 is provided at one end with a sharp cutting edge 50 which is in a plane that is slanted with respect to the axis of the cutter. The other end of the cutter is attached at holes 52 and 54 to a shaft 56 with a pin 58 extending through the holes in the cutter and a hole 60 in the shaft. As shown, the cutter includes a longitudinally extending slot 62. Shaft 56 extends through a slot 64 in a housing wall 66 and through a slot 68 in a washer 70 which is held against wall 66 by a helical spring 72 located on the shaft between the washer and a flanged end portion 74 of the shaft.

A lever 76 is pivotally mounted in tool 10 on a pin 78 which extends through holes 80 and 82 in housing portions 14 and 16, through holes 84 and 86 in flanges 88 and 90 on the handle, and through a hole 92 in a drive arm 94 which is an integral part of the lever 76. Large headed screws 96 and 98 which extend into the threaded ends of the pin 78 affix the pin to the housing portions of the tool. Drive arm 94 extends through a housing slot 100, through the body member slot 44, and into cutter slot 62 to bring an end portion 102 of the arm into engagement with end wall 104 of the cutter slot 62.

The handle 12 carries a block 106 of heat insulating material at one end 108. Pins 110 and 111 extending through holes 112 and 114 in upright flanges 116 and 118, respectively, on the block, and into bosses on the handle, such as boss 120, hold the block to the handle in a position where a marginal portion of the upper surface 122 of the block is engaged by housing edge portions 124, and tabs 128 on the block are held against tabs 130 at spaced locations within the handle. A platen 132 of a heat conductive material is carried by block 106. The platen includes wing portions 134 and 136 which extend from a central section 138 and engage block 106 in bottom recesses 140 and 142, respectively. Central section 138 extends through an opening 144 in the block, and a spring 146 in engagement with the block and the underside of flanges 148 and 150 on central section 138 hold the platten securely in the block. A thermistor 152 is carried in a through opening 154 in central section 138. The wires 156 and 158 of a cord enter handle 12 at the end 160 opposite from the block and platten carrying end, and extend through insulating sheath 162 in the handle to connect with the thermistor 152. Wires 156 and 158 connect through resistor 164 with a bulb 166 which is housed in an encasement 168 but visible through a plastic window 170 in the handle. Whenever the thermistor is energized by a plug 172 being plugged into an electrical outlet, the bulb is lit.

An opening 174 is provided in the handle as shown. The opening is normally closed by a curved plate like piece 176 pivoted in the housing at 178, but may be opened by upward pivotal movement of the plate like piece 176 to expose a cup-like formation 180 in the handle for collecting pieces of fabric removed from a piece of material by cutter 48.

Reference character 184 designates a fabric clamp according to the invention including aligned grooves 186 and 188 on one side, and including scoring in the grooves at 187 and 199 defining a fold line 190 for the clamp extending centrally between the grooves, and through a central opening 192 in the clamp as well as through rectangular openings 194 and 196 provided therein. Opening 192 includes perimetal edge portions defined by circular arcs 198 and 200 having different radii, but having a common center on the fold line 190. Circular arc 198 having the greater radius extends beyond a semicircle to slits 202 and 204. Circular arc 200 with the smaller radius also extends to slits 202 and 204, as shown. The slits 202 and 204 communicate with the rectangular openings 194 and 196 which extend to the grooved portions 186 and 188 respectively of the clamp. Other slits provided at 206, 208, 210 and 212 render portions 214 and 216 of the clamp bracketing the opening 192 slightly spreadable.

As shown, the clamp is provided with grid lines 218 and 220 with respect to which a patterned fabric can be located in a recallable manner. The clamp, which is preferably of a transparent plastic material, is receivable in a folded condition in handle 12. In use, the clamp with fabric folded therein is positioned in slots 40 and 42 in member 38 and handle 12. Clamp portions 214 and 216 are forced down around the outer cylindrical surface 222 of member 38 projecting into slot 42 and having substantially the same diameter as arc 198. The perimetal edge of clamp opening 192 along arc 198 is caused to engage cylindrical surface 222 of member 38, and the ends 224 and 226 of clamp portions 214 and 216 are caused to engage the bottom ends of a slot 228 in the handle. In the inserted position of the clamp in slots 40 and 42, outer surface 232 of the clamp is against the housing in slot 42, and outer surface 234 is engaged by a spring 236 which maintains the clamp in a closed condition. When the clamp has been positioned as described in the handle, the perimetal edge of the clamp along arc 200 is aligned with circular opening 46 in member 38 and the clamp cannot move in slots 40 and 42.

When a hole 238 in the fabric 240 of a garment of other article resulting from a cigarette burn, tear or the like, is to be repaired, the tool 10 may be used to effect a repair according to the method described in U.S. Pat. No. 4,406,723. The tool 10 is first used to cut out a disc of material at the damaged site. The fabric 240 is positioned on the unfolded clamp 184 so as to dispose an area of the article including the hole within opening 192, and with the fabric maintained in this position the clamp is folded upon the fabric as any lining 241 is pinched by the user away from the fabric. A patterned fabric is located in a recallable manner with respect to grid lines 218 and 220 for a reason hereinafter made apparent. In order to prevent movement of the fabric from a selected position, inside areas 242 and 244 on the clamp are preferably rendered sticky to the fabric as with an applied facing 246 having an adhesive coating on each of its opposite sides. After the fabric has been folded in the clamp, the clamp is located in slots 40 and 42 as hereinbefore indicated. Handle 12 is held in the palm of the hand and lever 76 is squeezed to cause drive arm 94 thereon to move cutter 48 down circular opening 46 in the body member 38, through the clamp opening 192. As the sharp edge 50 of the cutter moves through the clamp, it performs a shearing function cutting out a semi-circular portion of the fabric 240 in each of its folded layers and leaving a clean circular hole 248 in the fabric when unfolded in place of the nondescript hole 238. The portion of fabric removed by the cutter drops into cup like formation 180. Spring 72 is compressed between washer 70 and portion 74 of shaft 56 as the cutter is moved to perform its shearing function, and serves both to retract the cutter and return lever 76 to a normal unactuated position when pressure on the lever is released.

After the damaged area of fabric 240 has been removed leaving hole 248, a circular patch 250 of the same size as the hole is obtained by again utilizing tool 10 in the manner described, but on an undamaged portion of fabric. The patch is retrieved from cup like formation 180, and the portion of the fabric previously cut from the damaged site is discarded. The patch for a damaged garment is best obtained from an inconspicuous part of the garment such as a cuff, hem or internal seam. As previously noted, when a damaged portion of a patterned fabric is located in clamp 184, the pattern is positioned with respect to grid lines 218 and 220. By similarly locating the patterned fabric for the patch with respect to such grid lines in the clamp, a patch may be obtained, which can be suitably positioned in hole 248 to continue the pattern of the surrounding area.

Figure 10:
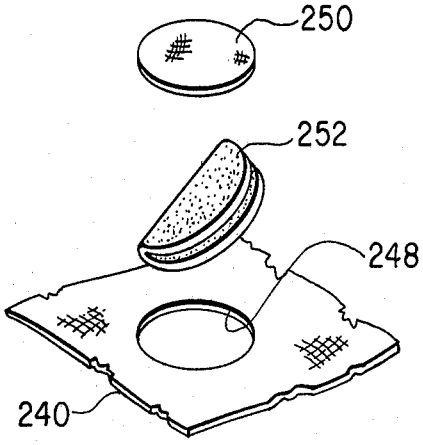
FIG. 10 is a perspective view showing the fabric with a hole formed therein, a thermoplastic pad for insertion through the hole, and a formed patch for the hole.
Figure 9:
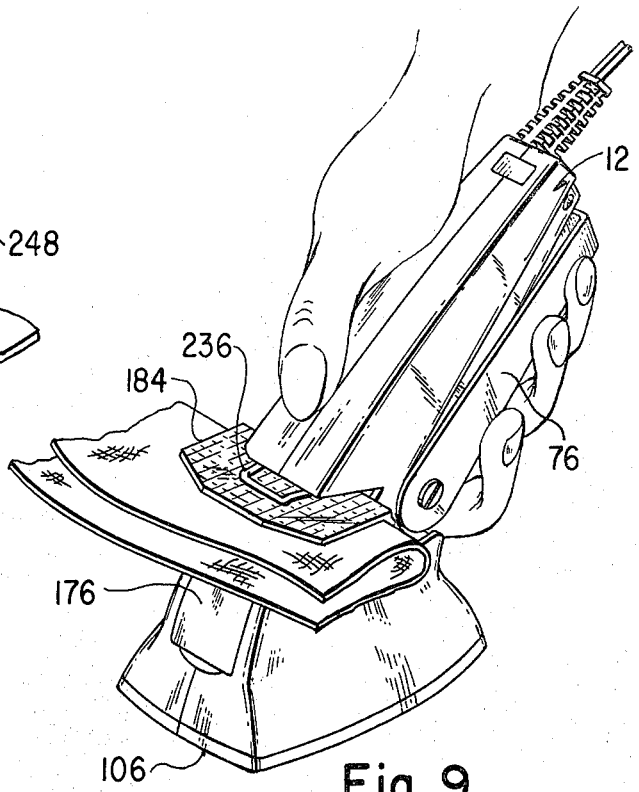
FIG. 9 is a perspective view showing the clamp in the tool.
Figure 11:
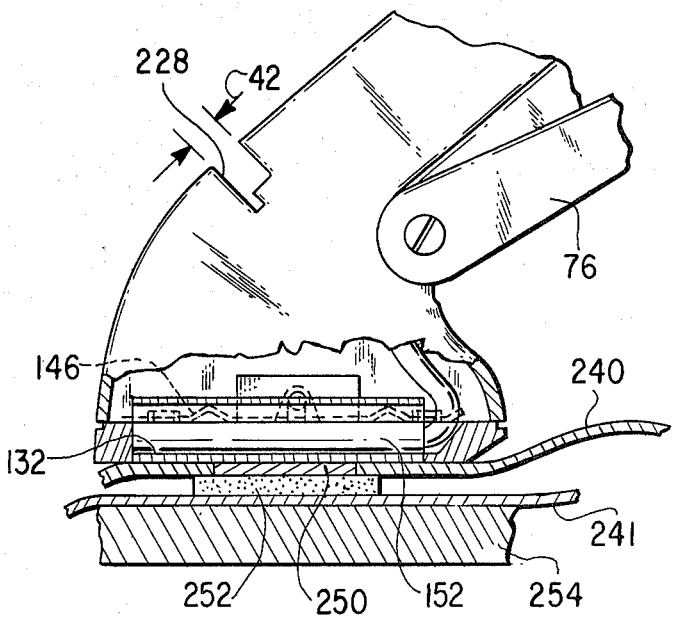
FIG. 11 is a perspective view indicating the application of said patch to the damaged fabric.

Patch 250 is applied to fabric 240 by first locating a pad 252, which is impregnated with a thermoplastic adhesive and which is somewhat larger than the hole 248, on the normally unexposed side of the fabric in a position wherein the pad completely overlaps the hole. The pad is folded as shown in FIG. 10, so that it may pass through the hole 248. After the pad has been suitably located patch 250 is positioned in the hole and platten 132 is heated by inserting plug 172 into an electrical outlet to energize thermistor 152. The platten is positioned over and pressed down upon patch 250 with the handle 12 while the thermoplastic pad 252 is supported on an available flat surface 254. Heat from the platten melts the thermoplastic adhesive in the upper surface portion of the pad and causes it to flow into the interstices of adjacent portions of the fabric to complete a repair. The thermistor 152, which is a device that quickly attains and is maintained at some particular temperature, is selected to cause the platten to be heated to a temperature effective to melt only the thermoplastic adhesive in the upper surface portion of the pad as required to securely bond the pad to the patch and fabric.

It is to be understood that the present disclosure relates to a preferred embodiment of the invention which is for purposes of illustration only and is not to be construed as a limitation of the invention. Numerous alterations and modifications will suggest themselves to those skilled in the art, and all such modifications which do not depart from the spirit and scope of the invention are intended to be included within the scope of the appended claims.

We claim:

1. In a fabric repairing tool, a body member, a cutter slidable in said member, a foldable clamp with a through opening which extends to opposite sides of a fold line, and wherein a fabric portion can be located and then folded with the clamp, and a slot in the body member for receiving the then folded clamp in a position wherein the said fabric portion is in the path of movement of the cutter.

2. The combination of claim 1 wherein, the cutter is cylindrical in form and has a sharp cutting edge in a plane which is slanted with respect to the axis of the cutter.

3. The combination of claim 1 wherein the clamp is formed of a plastic material having grooves wherein the fold line of the clamp is defined.

4. The combination of claim 1 including grid lines on the clamp to assist in the positioning of patterned fabric thereon.

5. The combination of claim 1 wherein fabric engaging surfaces of the clamp include an adhesive coating.

6. The combination of claim 1 including a handle wherein the body member is affixed, and a manually operable pivotable lever for moving the cutter.

7. The combination of claim 1 including means for catching cut fabric portions of material.

8. The combination of claim 1 including a handle wherein the body member is affixed, a manually operable pivotable lever for moving the cutter, an opening in the handle, means within the opening for receiving cut fabric portions of material, and means for closing said opening or exposing the fabric receiving means.

9. The combination of claim 1 including means for preventing movement of the folded clamp in said slot.

10. The combination of claim 1 including a handle wherein the body member is affixed, a manually operable pivotable lever for moving the cutter, and a heatable platten in one end of the handle.

11. The combination of claim 10 including means for heating the platten to and maintaining the platten at a controlled temperature.

* * * * *